US011380502B2

(12) United States Patent
Miura et al.

(10) Patent No.: US 11,380,502 B2
(45) Date of Patent: Jul. 5, 2022

(54) ELECTROMAGNETIC SWITCH CONTROL DEVICE

(71) Applicant: Hitachi Astemo, Ltd., Hitachinaka (JP)

(72) Inventors: Hikaru Miura, Hitachinaka (JP); Tomonori Kanai, Hitachinaka (JP); Akihiro Machida, Hitachinaka (JP); Tatsumi Yamauchi, Hitachinaka (JP)

(73) Assignee: Hitachi Astemo, Ltd., Hitachinaka (JP)

( * ) Notice: Subject to any disclaimer, the term of this patent is extended or adjusted under 35 U.S.C. 154(b) by 0 days.

(21) Appl. No.: 17/285,949

(22) PCT Filed: Sep. 12, 2019

(86) PCT No.: PCT/JP2019/035826
§ 371 (c)(1),
(2) Date: Apr. 16, 2021

(87) PCT Pub. No.: WO2020/079998
PCT Pub. Date: Apr. 23, 2020

(65) Prior Publication Data

US 2021/0391133 A1 Dec. 16, 2021

(30) Foreign Application Priority Data

Oct. 17, 2018 (JP) ..... JP2018-196081

(51) Int. Cl.
*H01H 47/22* (2006.01)
*H01H 47/00* (2006.01)

(52) U.S. Cl.
CPC ..... *H01H 47/22* (2013.01); *H01H 47/002* (2013.01)

(58) Field of Classification Search
CPC .... H01H 47/22; H01H 47/002; H01H 47/325; H01H 47/04

(Continued)

(56) References Cited

U.S. PATENT DOCUMENTS 10,101,393 B2 * 10/2018 Bock ..... H01H 50/002
2013/0235505 A1 * 9/2013 Takeshita ..... H01H 47/02 361/187
2018/0174786 A1 * 6/2018 Matsuo ..... H01H 47/32

FOREIGN PATENT DOCUMENTS

JP 2011-4103 A 1/2011
JP 2018-133949 A 8/2018
WO WO 2017/159070 A1 9/2017

OTHER PUBLICATIONS

International Search Report (PCT/ISA/210) issued in PCT Application No. PCT/JP2019/035826 dated Nov. 12, 2019 with English translation (five (5) pages).

(Continued)

*Primary Examiner* — Dharti H Patel
(74) *Attorney, Agent, or Firm* — Crowell & Moring LLP

(57) ABSTRACT

Provided is an electromagnetic switch control device capable of stabilizing a contact pressure by predicting a near-future value of an operation coil current and performing control such that the near-future value does not fall below a holding current threshold value by a control unit. An electromagnetic switch control device 1 opens and closes 13 by an electromagnetic force corresponding to energization of operation coils 16 and 17, and includes PWM control units 21 to 23 that perform PWM pulse width modulation control of a current value A flowing through the operation coils 16 and 17. The PWM control units 21 to 23 estimate the near-future predicted current value flowing through the operation coils 16 and 17 by using a terminal voltage V of the operation coils 16 and 17, and perform PWM control based on the estimated current value. The predicted current value Y is estimated by using an impedance Z of the operation coils 16 and 17. The impedance is a variable obtained by current values A1 and A2 and terminal voltages V1 and V2 of the operation coils 16 and 17, and a constant (Continued)

approximated over a predetermined period from a latest past to a present time is used. The impedance is updated for each predetermined period.

8 Claims, 5 Drawing Sheets

(58) Field of Classification Search
USPC ..... 361/160
See application file for complete search history.

(56) References Cited

OTHER PUBLICATIONS

Japanese-language Written Opinion (PCT/ISA/237) issued in PCT Application No. PCT/JP2019/035826 dated Nov. 12, 2019 (five (5) pages).

* cited by examiner

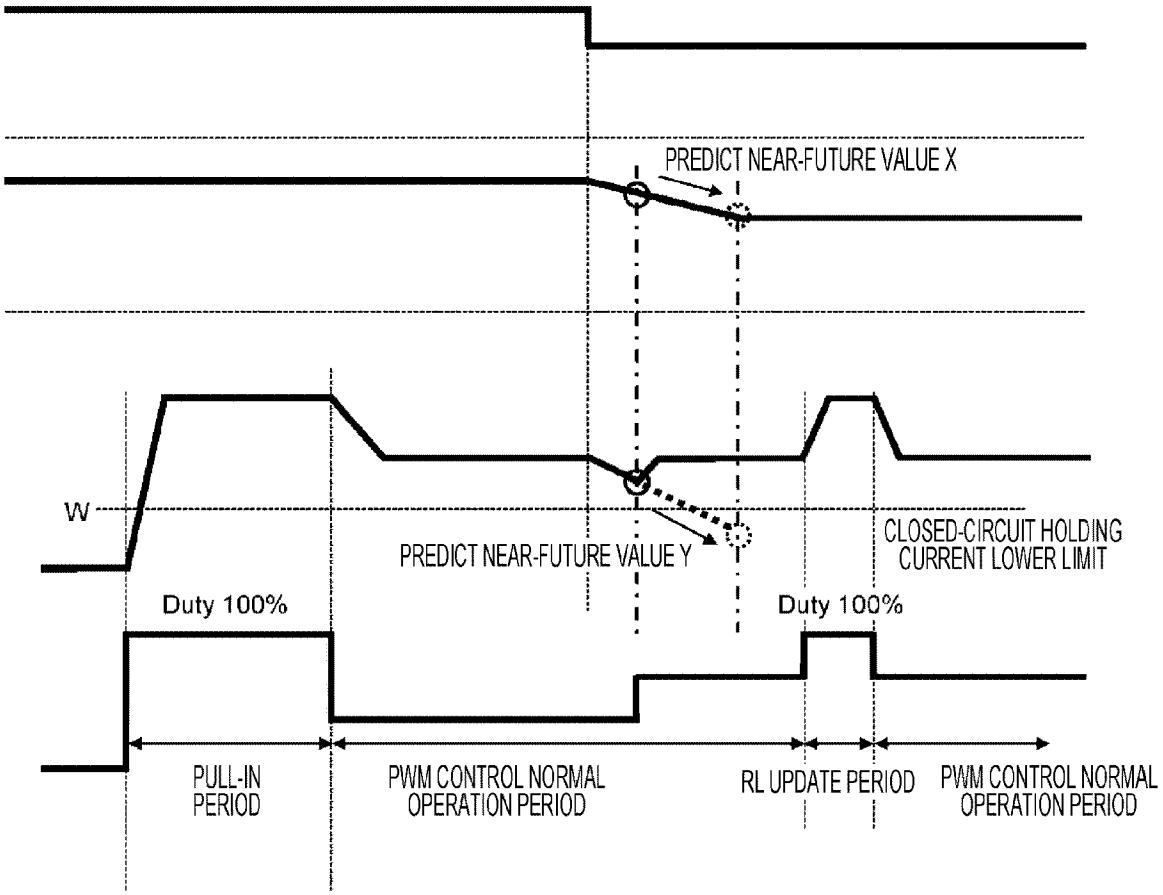
FIG. 4A SUPPLY VOLTAGE Vcc
FIG. 4B TERMINAL VOLTAGE V
FIG. 4C OPERATION COIL CURRENT A
FIG. 4D PWM CONTROL Duty RATIO

ELECTROMAGNETIC SWITCH CONTROL DEVICE

TECHNICAL FIELD

The present invention relates to an electromagnetic switch control device, and particularly, to an electromagnetic switch control device that controls opening and closing of an electromagnetic switch that is inserted between a power supply and a load and is connected to open and close a conductive path.

BACKGROUND ART

As illustrated in PTL 1, an operation coil drive device that calculates an impedance of an operation coil (inductive load) of an electromagnetic switch and performs control such that an appropriate current is supplied at the time of an opening and closing operation of the electromagnetic switch has been known.

CITATION LIST

Patent Literature

PTL 1: WO 2017/159070 A

SUMMARY OF INVENTION

Technical Problem

In a power supply system using an assembled battery in which a plurality of battery cells is connected in series or in parallel, when pulse control of an electromagnetic switch (inductive load) connected to an assembled battery and a load on the system side is performed, it is necessary to energize a holding current to be held by an electromagnetic switch in a closed circuit (hereinafter, also referred to as "on") state.

When a contact resistance of an electrical contact (hereinafter, also referred to as a "contact portion" or simply a "contact") in the electromagnetic switch increases, heat generation deteriorates at the time of the closed-circuit energization. As stated above, when the charge and discharge current of the assembled battery is energized in a state in which the contact resistance of the contact (hereinafter, also referred to as "contact resistance") increases, there is a concern that the electromagnetic switch is welded and fails due to the heat generated by the contact.

In order to avoid such a failure, it is necessary to perform control such that an operation can be continued safely. In an unstable case in which an operation coil current does not satisfy a lower limit (hereinafter, also referred to as a "minimum holding current" or simply a "holding current") for generating an electromagnetic force to reliably attract and maintain the contact even at the time of the closed-circuit energization control, since a contact pressure is not sufficient, an arc is caused at the contact, and thus the contact may be gradually damaged, and the contact resistance may be increased. In order to avoid such a situation, it is necessary to sufficiently secure the contact pressure by stably supplying the operation coil current as specified.

When an overload exceeding the supply capacity of the power supply system, the over-discharging of the battery, or causes thereof act together and the supply voltage drops, the operation coil current of the electromagnetic switch is reduced and becomes insufficient. As described above, this causes an increase in the contact resistance. To avoid this, it is necessary to suppress the decrease in the operation coil current.

Thus, when a control unit can detect in advance that the operation coil current is equal to or lower than a control lower limit (hereinafter, also referred to as a "holding current threshold value" or simply a "holding current"), it is effective to control so as not to fall below the holding current threshold value of the operation coil based on the detection result. For example, an on-duty of a switching element is controlled such that an operation coil current A does not fall below the holding current as long as the control is PWM control. In other words, control is performed in a direction in which the duty ratio of on or off approaches 100%, that is, such that an on time becomes longer than an off time.

However, the technology described in PTL 1 cannot predict a near-future value of the operation coil current. Accordingly, there is a problem that the control unit cannot detect in advance so as not to fall below the holding current threshold value of the operation coil and the decrease in the operation coil current cannot be suppressed. The present invention has been made to solve such problems, and an object of the present invention is to provide an electromagnetic switch control device capable of stabilizing a contact pressure by predicting ae near-future value of an operation coil current in advance and performing control such that the near-future value does not fall a holding current threshold value by a control unit.

Solution to Problem

In order to solve the above problems, the present invention is an electromagnetic switch control device that energizes a current value having a PWM-controlled duty ratio to an operation coil, and opens and closes an electrical contact by an electromagnetic force corresponding to the current value. The electromagnetic switch control device includes a current value prediction unit that estimates a near-future predicted current value by using a terminal voltage value of the operation coil, a control range determination unit that determines whether or not the estimated predicted current value is out of a range in which a current of the operation coil is holdable, and a PWM control unit that performs control such that the duty ratio is changed based on the predicted current value when the determination result of the control range determination unit is out of the range.

Advantageous Effects of Invention

Provided is an electromagnetic switch control device capable of stabilizing a contact pressure by predicting a near-future value of an operation coil current and performing control such that the near-future value does not fall below a holding current threshold value by a control unit.

BRIEF DESCRIPTION OF DRAWINGS

FIG. 2A illustrates opening and closing timings of a main switch 7-1, FIG. 2B illustrates opening and closing timings of a main switch 7-2, FIG. 2C illustrates opening and closing timings of a sub switch 8.

FIGS. 4A-4D comprise a timing chart illustrating changes in a voltage and a current of an operation coil by the PWM control in the present device of FIG. 1 and FIG. 3, FIG. 4A illustrates a supply voltage Vcc, FIG. 4B illustrates a terminal voltage V of the operation coil, FIG. 4C illustrates a current value A of the operation coil, and FIG. 4D illustrates a duty ratio of the PWM control.

FIG. 5A illustrates pull-in processing, FIG. 5B illustrates voltage and current measurement and duty update processing, and FIG. 5C illustrates acquisition processing of a resistance R value and an inductance L value (hereinafter, abbreviated as "RL").

DESCRIPTION OF EMBODIMENTS

Figure 1:
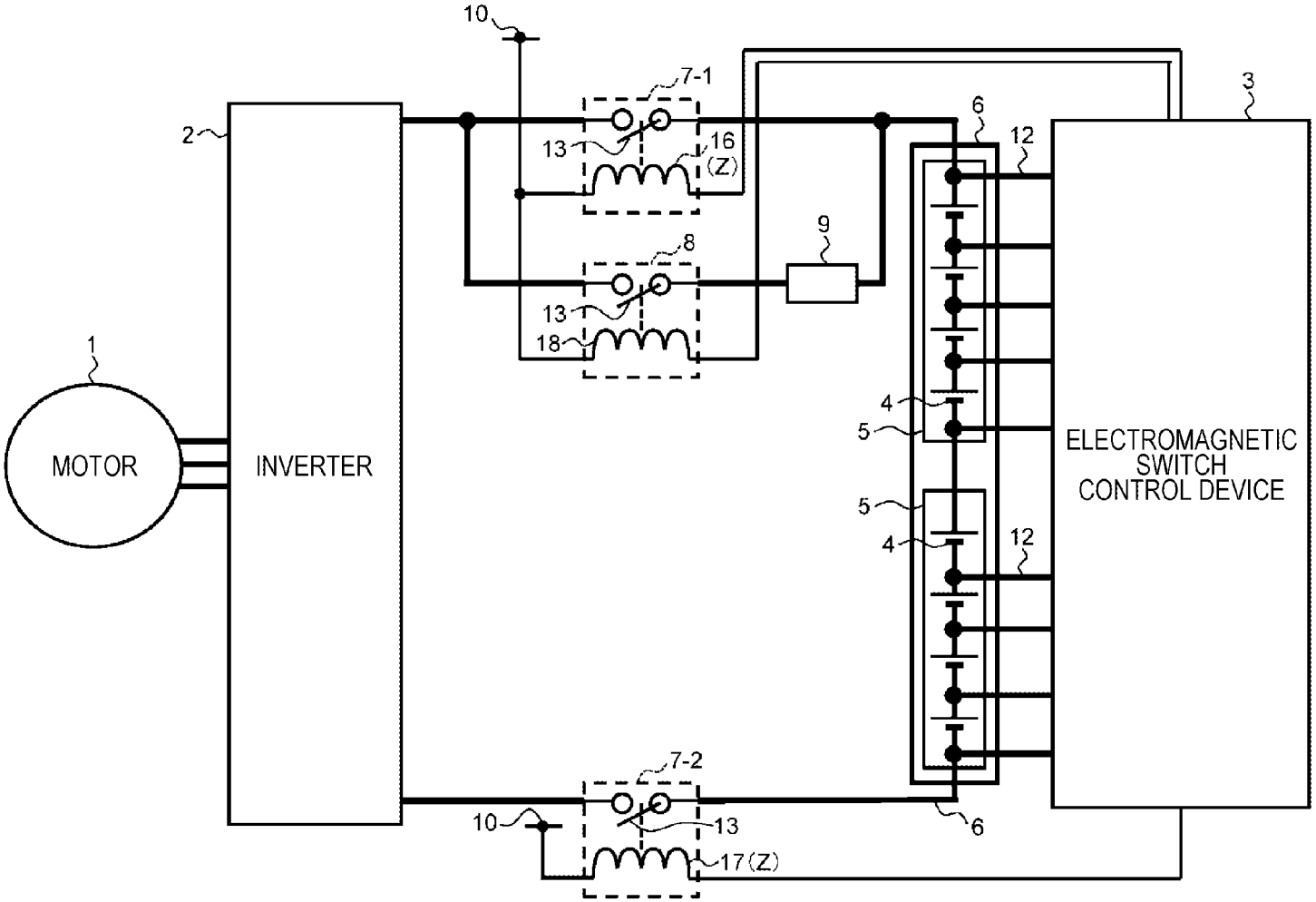
FIG. 1 is a circuit diagram illustrating a schematic configuration of a battery-type power supply system using an electromagnetic switch control device (hereinafter, also referred to as "present device") according to an embodiment of the present invention.

Hereinafter, an application example of the present device to a battery-type power supply system will be described with reference to the drawings. FIG. 1 is a circuit diagram illustrating a schematic configuration of a battery-type power supply system (hereinafter, also referred to as "present system") using the present device. As illustrated in FIG. 1, the present system includes a motor 1, an inverter 2, the present device 3, an assembled battery 6, main contactors (hereinafter, also referred to as "main switches" or "electromagnetic switches") 7-1 and 7-2 (two switches are collectively 7), a precharge relay (hereinafter, also referred to as a "sub switch" or an "electromagnetic switch") 8, and a precharge resistor 9.

The assembled battery 6 is configured such that a desired voltage is obtained in a whole assembled battery in which two battery modules 5 are connected in series. The battery module 5 is configured such that a desired half voltage is obtained in a unit in which four battery cells 4 as secondary batteries are connected in series. All the battery modules 5 and the battery cells 4 constituting the assembled battery 6 illustrated herein are connected in series with additive polarities, but are appropriately connected in series, in parallel, or in combination thereof depending on the application.

As described above, nine voltage measuring lines 12 are drawn out from electrode terminals in the eight battery cells 4 constituting the assembled battery 6 in the form of being connected in series with all additive polarities. These nine voltage measuring lines 12 are connected to the present device 3 including a microcomputer, and are configured to be able to monitor a charging or discharging status and other management items. The number of battery cells is not limited to eight, and the battery cells 4 may be appropriately connected in series or in parallel. The voltage measuring lines 12 having connection forms corresponding to various different monitoring purposes and management specifications may be connected to the present device 3, but illustration and description thereof will be omitted.

The motor 1 is a load of the inverter 2. The inverter 2 is a load of the assembled battery 6. The assembled battery 6 is connected to the inverter 2 with a total of three electromagnetic switches including two main switches (electromagnetic switches) 7 and the sub switches (electromagnetic switch) 8 interposed therebetween. These three electromagnetic switches 7 and 8 can control a conductive state to either a closed or open circuit (on/off) by the present device 3.

The main switch 7-1 is inserted in an electric circuit on a positive electrode side of the assembled battery 6 and has a function of instantly opening and closing for most of the current. The main switch 7-2 is inserted in an electric circuit on a negative electrode side of the assembled battery 6 and has a function of instantly opening and closing for a total current. On the other hand, the sub switch 8 is inserted in the same electric circuit on the positive electrode side as the main switch 7-1, and has a function of opening and closing for a small current limited to some extent. The sub switch 8 is controlled to be turned on or off at an appropriate timing set by a general-purpose input/output (GPIO) to be described later.

The extent to which the current of the sub switch 8 is limited to a small value is defined by a resistance value of the precharge resistor 9 connected in series with the sub switch 8. The sub switch 8 to which the precharge resistor 9 is connected in series is connected, as an inrush current prevention relay, in parallel to the main switch 7-1. The present device 3 monitors the charging and discharging state of each of the individual battery cells 4 constituting the assembled battery 6. As will be described later with reference to FIG. 2, the present device 3 controls the opening and closing of the main switches 7 and the sub switch 8 inserted between the assembled battery 6 and the inverter 2 at appropriate timings.

The electromagnetic switch control device (present device) 3 is a control device that energizes operation coils 16 and 17 of the electromagnetic switches 7 with a current value A having a PWM-controlled duty ratio (hereinafter, also simply referred to as a "duty ratio") and opens and closes electrical contacts 13 of the electromagnetic switches 7 by an electromagnetic force corresponding to the current value A. The present device 3 includes a current value prediction unit 19, a control range determination unit 20, and a PWM control unit 21.

The current value prediction unit 19 estimates a near-future predicted current value Y by using terminal voltages V1 and V2 (collectively V) of the operation coils 16 and 17, respectively. The control range determination unit 20 determines whether or not the estimated predicted current value Y is out of a range in which the current of the operation coils 16 and 17 is holdable, that is, the electromagnetic force to maintain the contacts 13 in an attraction state is exhibitable and maintainable.

The PWM control unit 21 controls to change the duty ratio based on the predicted current value Y when the determination result of the control range determination unit 20 is out of the range in which the electromagnetic force is maintainable. Since the present device 3 is configured in this manner, the PWM control unit 21 can stabilize a contact pressure of the contacts 13 by predicting a near-future value X of the operation coil current A and performing control such that the near-future value does not fall below a holding current threshold value W.

Figures 2A, 2B, 2C:
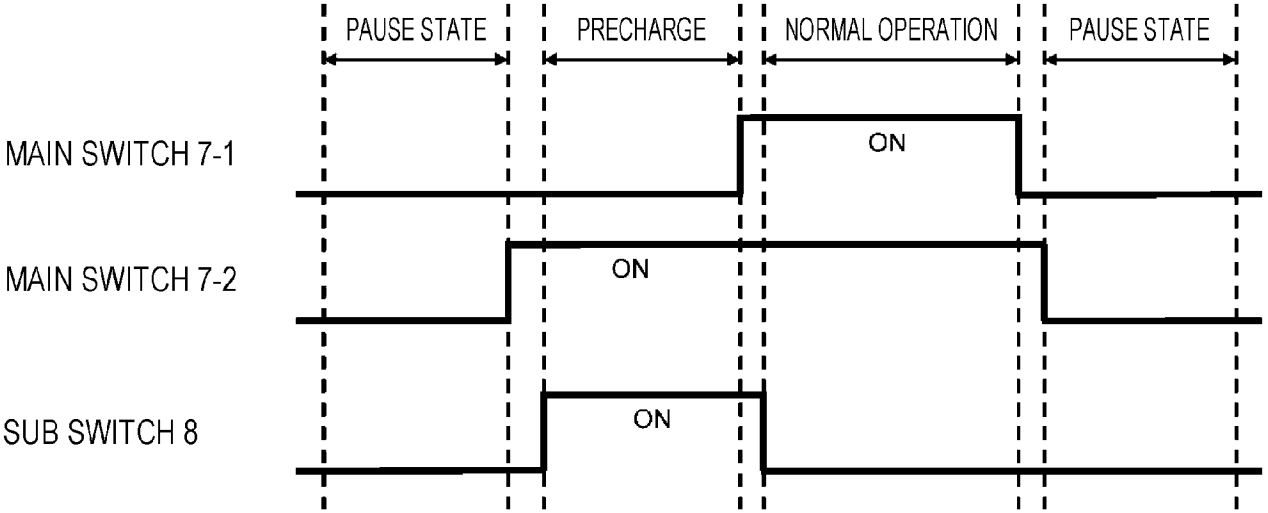
FIGS. 2A-2C comprise a timing chart briefly illustrating PWM control in the present device of FIG. 1.

FIG. 2 is a timing chart briefly illustrating PWM control in the present device of FIG. 1. FIG. 2(*a*) illustrates opening and closing timings of the main switch 7-1, FIG. 2(*b*) illustrates opening and closing timings of the main switch 7-2, and FIG. 2(*c*) illustrates opening and closing timings of the sub switch 8. As illustrated in FIG. 2, when the assembled battery 6 is connected to the inverter 2, the present device 3 limits such that an inrush current does not exceed an allowable current of the main switch 7 by the precharge resistor 9 by connecting the sub switch 8 earlier than the main switch 7-1 in order to prevent the inrush current. An electromagnetic switch power supply (contactor power supply) 10 is energized to the operation coils 16, 17, and 18, and thus, the present device 3 closes (on) each contact 13. In contrast, when the energization is stopped (off), the contact is open by a spring (not illustrated).

More specifically, for example, in a hybrid vehicle or a storage battery vehicle, connection and disconnection (on/off) are supported between a DC power supply and a load. Thus, as illustrated in FIG. 2, the sub switch 8 is timing-controlled by the GPIO such that the sub switch closes at a timing slightly earlier than the main switch 7-1 when the switch is closed. By this timing control, an effect of protecting the contacts of the main switches 7 can be exhibited by precharging to relax the inrush current when a large-current DC electric circuit having a capacitor in the load is closed.

Figure 3:
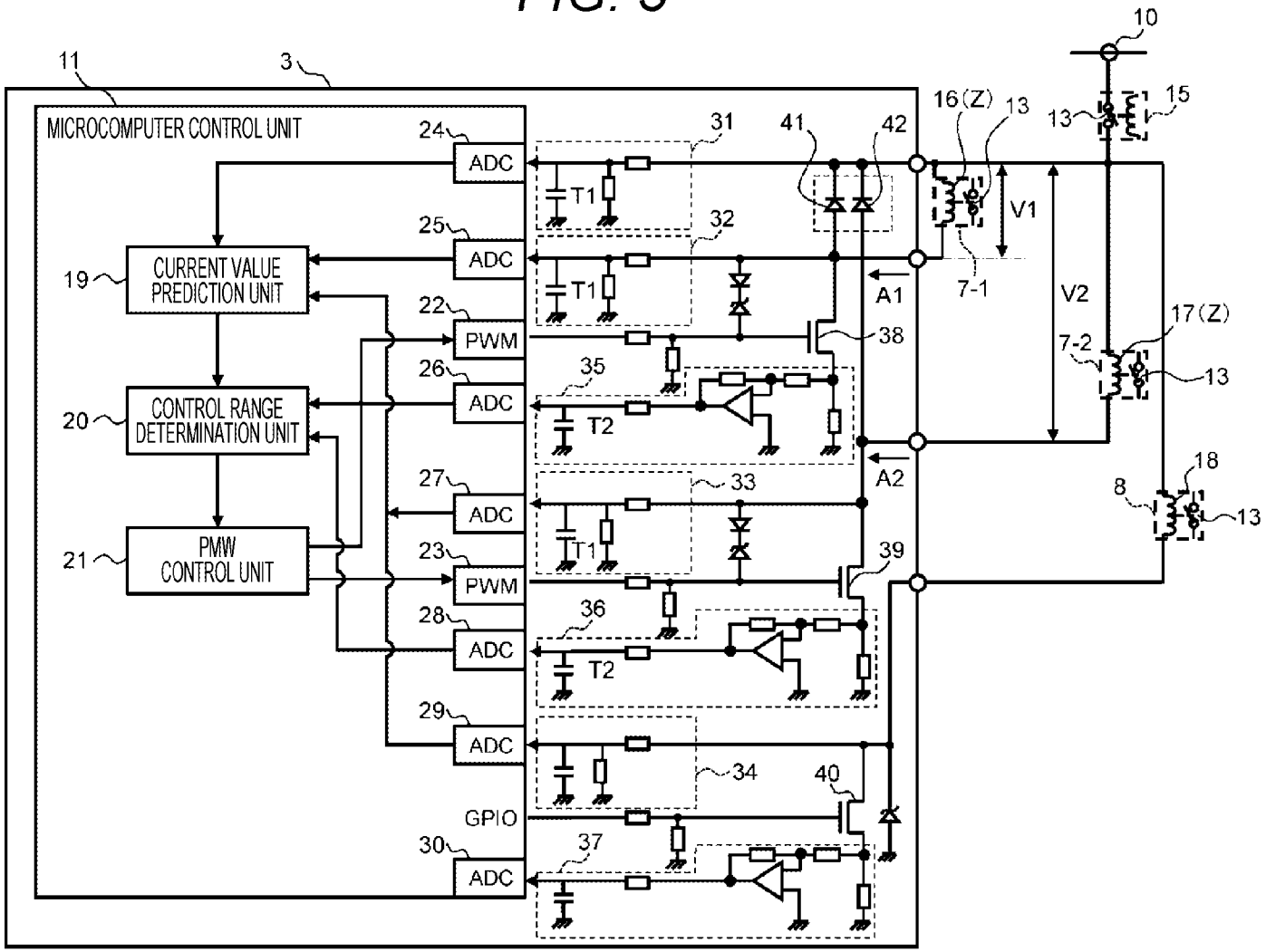
FIG. 3 is a circuit diagram illustrating the present device of FIG. 1 in more detail.

Next, a circuit configuration of the present device 3 will be described with reference to FIG. 3. FIG. 3 is a circuit diagram illustrating the present device 3 of FIG. 1 in more detail. In FIG. 3, the assembled battery 6 which is a power supply and the motor and the inverter 2 which are the loads are omitted, and the main part of the present device 3 is mainly constituted by a microcomputer control unit 11 which controls the main switches 7 and the sub switch 8. A coil current contactor (coil switch or electromagnetic switch) 15 has a function of a main switch that simultaneously controls to energize the electromagnetic switch power supply (contactor power supply) 10 to all the operation coils 16 to 18. However, it is assumed that the coil current contactor is constantly in an on state.

The control unit constituting the main part of the present device 3 is constituted by an RC filter circuit which is a combination of a resistor R and a capacitor C that set time constants T1 and T2 [seconds] and freewheeling diodes 41 and 42 in addition to switching elements 38 to 40 that are connected to the microcomputer control unit 11 and operate to be turned on or off.

The definitions of the time constant T [seconds] will be described later.

The microcomputer control unit 11 includes the current value prediction unit 19, the control range determination unit 20, PMW control units 21 to 23, and A/D converters (ADCs) 24 to 30. Of these components, the PMW control unit 21 is branched into the PWM control units 22 and 23 to perform independent operations. These components are not necessarily included in the microcomputer control unit 11, and may have a scattered configuration.

Signals are input and output to and from the microcomputer control unit 11. Signals are input and voltage and current values are input, as analog signals, to the ADCs 24 to 30, and A/D conversion is performed on these signal so as to be suitable for the processing of the microcomputer. Thus, the ADCs 24, 25, 27, and 29 form an operation coil voltage measurement circuit, and the ADCs 26, 28, and 30 form an operation coil current measurement circuit. On the other hand, the PMW control units 21 to 23 output High and Low signals that turn on and off the switching elements 38 and 39. The GPIO of the microcomputer control unit 11 outputs High and Low signals that turn on and off the switching element 40. The switching elements 38 to 40 control the energization of the main switches 7, the sub switch 8, and the operation coils 16 to 18, respectively.

As described above, the present device 3 forms a control function for appropriately turning on and off the electric circuit in a combination in which the battery-type power supply system formed by the assembled battery 6 constituted by the plurality of secondary batteries 4 connected in series, the loads that receive the supply of the power from the system, and the electromagnetic switches 16 to 18 inserted into current paths thereof. The present device 3 illustrates, for example, an embodiment adopted in the hybrid vehicle or the storage battery vehicle (not illustrated). The operation coil voltage measurement circuits (also referred to as the "ADCs") 24, 25, and 27 and voltage measurement filter circuits 31, 32, and 33 are further connected to the assembled battery 6.

The ADCs 24, 25, 27, and 29 measure the terminal voltage V of the operation coils 16, 17, and 18. The voltage measurement filter circuits 31, 32, 33, and 34 are low-pass filters provided between the operation coils 16, 17, and 18 and the ADCs 24, 25, 27, and 29, and remove radio frequency components such as spike noise harmful to voltage measurement. Due to these configurations, the predicted current value Y that changes transiently can be calculated by using the terminal voltage V of the operation coils 16 and 17, an impedance Z of the operation coils 16 and 17, and the time constant T1 of the voltage measurement filter circuits 31, 32, and 33.

The present device 3 further includes the operation coil current measurement circuits (ADCs) 26, 28, and 30 and current measurement filter circuit 35, 36, and 37. The operation coil current measurement circuits 26, 28, and 30 measure the current energized to the operation coils 16 and 17. The current measurement filter circuits 35, 36, and 37 are low-pass filters provided between the operation coils 16, 17, and 18 and the operation coil current measurement circuits 26, 28, and 30, and remove radio frequency components such as spike noise harmful to current measurement.

The impedance Z is calculated by using the terminal voltage V, the time constant T1 of the voltage measurement filter circuits 31, 32, and 33, the current value A, and the time constant T2 of the current measurement filter circuits 35 and 36. This impedance Z is calculated from the terminal voltage V of the operation coils 16 and 17 during an on period in which the duty ratio in the PWM control is 100% in order to set the contact in a closed circuit state, and the current value A. Impedance Z=terminal voltage V/current value A. The terminal voltages V1 and V2 and the current values A1 and A2 of the operation coils 16 and 17 are collectively abbreviated as the terminal voltage V and the current value A, respectively.

The microcomputer control unit 11 switches between on and off states of the sub switch 8 by turning on and off the switching element 40 with an output signal of either the High or Low signal from the GPIO. Similarly, the microcomputer control unit 11 switches between the on and off states of the main switches 7-1 and 7-2 by turning on and off the switching elements 38 and 39 with pulse control signals output from the PWM control units 21 to 23. For example, when the switching elements 38 to 40 are constituted by NPN type transistors or the like, the current is energized to the operation coils 16 to 18 in a period in which the output signal of the microcomputer control unit 11 is High.

On the contrary, in order to set the main switches 7 and 8 to be surely in an off state by switching the output signal of the microcomputer control unit 11 from High to Low, it is necessary to quickly extinguish an exciting current in an opposite direction due to inductive components of those operation coils 16 to 18.

The exciting current escapes as a reflux current passing through the freewheeling diodes 41 and 42, and thus, the exciting current that tends to continue to flow through the operation coils 16 to 18 can be quickly extinguished.

Figure 5A:
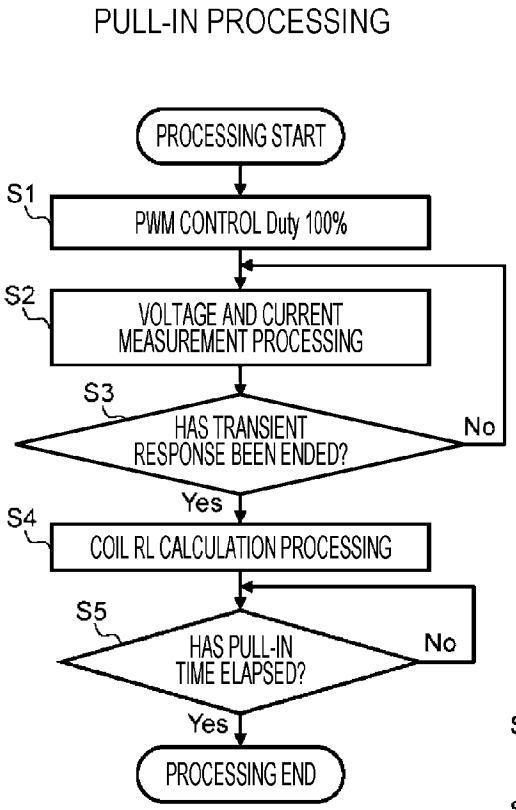
FIGS. 5A-5C comprise a flowchart illustrating a processing procedure when the operation coil is controlled by the present device of FIG. 1 and FIG. 3.

Next, the duty control for the current A in an on period of the main switches 7, that is, while being energized to the operation coils 16 and 17 will be described with reference to FIGS. 4 and 5. The operation coil 18 of the precharge relay (sub switch) 8 does not need to be duty-controlled.

FIG. 4 is a timing chart illustrating changes in the voltage and current of the operation coil due to the PWM control in the present device of FIGS. 1 and 3. FIG. 4(*a*) illustrates a supply voltage Vcc, FIG. 4(*b*) illustrates the terminal voltage V of the operation coil, FIG. 4(*c*) illustrates the current value A of the operation coil, and FIG. 4(*d*) illustrates the duty ratio of the PWM control.

Ideally, the supply voltage Vcc of FIG. 4(*a*) and the terminal voltage V of the operation coil in FIG. 4(*b*) are constantly maintained at constant levels as illustrated in the left half of each figure. However, as in the battery-type power supply system (the present system), in a power supply system using a battery, when there is a large load for supply capacity, even though there is constant voltage guarantee means, it is necessary to assume a voltage fluctuation (especially a drop) to some extent.

When the supply voltage Vcc drops as illustrated near a center in a horizontal direction of FIG. 4(*a*), the near-future value is predicted based on a change direction of the measured value V due to the ADCs 24, 25, and 27 as illustrated near the center in the horizontal direction of FIG. 4(*b*). On the other hand, as illustrated in chronological order from left to right in FIG. 4(*d*), the duty ratio of the PWM control is appropriately controlled by the microcomputer control unit 11 from 0 to 100% by internal arithmetic processing.

The current value A of the operation coil illustrated in FIG. 4(*c*) is controlled from 0 to 100% so as to follow the duty ratio of the PWM control. However, although there is a time delay, as will be described later, the duty ratio is controlled from 0 to 100% such that there is no excess or deficiency by the internal arithmetic processing while the microcomputer control unit 11 monitors the changes in the terminal voltage V and the current values A1 and A2 (collectively A) of the operation coils 16 and 17 illustrated in FIGS. 4(*b*) and 4(*c*).

More specifically, the following three types of operation modes <1> to <3> are executed for periods in chronological order from left to right in FIG. 4.

Figure 5B:
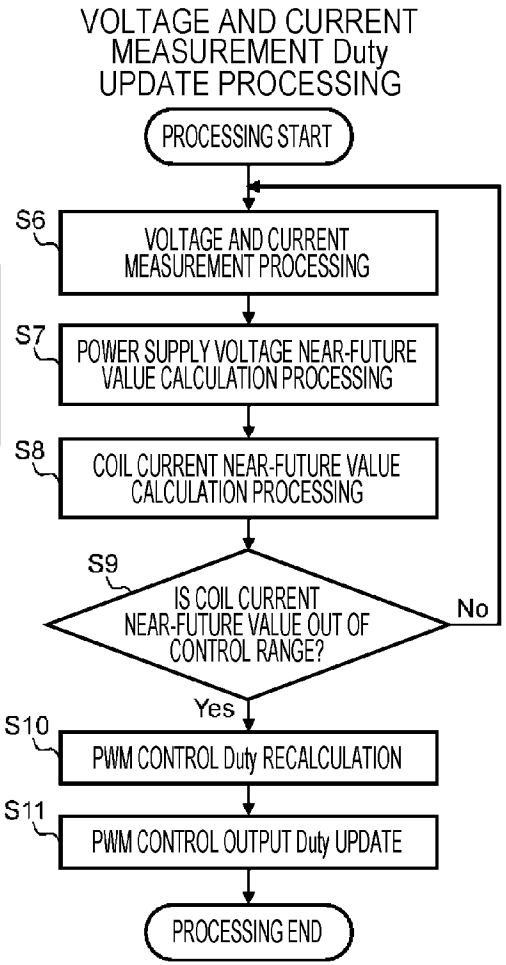

<1> A pull-in mode is a mode in which a duty ratio of 100% is output in order to reliably maintain the attraction state in a pull-in period immediately after the contact 13 is attracted (see FIG. 5(*a*)).

<2> A holding current maintaining mode is a mode in which the current value A of the operation coils 16 and 17 is reduced by the PWM control in a normal operation period in which the attraction state of the contact 13 is maintained but is maintained by a holding current W that does not fall below a minimum required limit (see FIG. 5(*b*)).

<3> An RL update period mode is a mode in which the PWM control duty is 100% in an RL update period for correcting the amount of drift of the impedance Z of the operation coils 16 and 17 in the electromagnetic switch 7 as in the pull-in period (see FIG. 5(*c*)).

In the above mode <1>, when the main switch 7 is turned from off to on, the current value A is sharply increased to 100% by first setting the duty ratio to 100%. As a result, the contact 13 of the main switch 7 opened by an elastic force of a spring (not illustrated) is turned from off to on by being attracted (pulled in). In the above mode <2>, both the duty ratio and the current value A can be relaxed from 100% to near a closed-circuit holding current lower limit (holding lower limit) W in order to maintain the on state.

However, in this mode <2>, when the supply voltage Vcc and the terminal voltage V drop for some reason while the main switch 7 is maintained in the on state, the current value A required to maintain the main switch 7 in the on state falls below the holding lower limit value W, and thus, it is expected that the main switch is turned off unexpectedly. In order to avoid such an expected defect, the PWM control is performed such that the current value A greatly exceeds the holding lower limit W in the above mode <2>.

After the PWM control to counteract such a drop expectation, in the above mode <3>, a period in which a resistance value R and an inductance L value (abbreviated as "RL") of the operation coils 16 and 17 in the electromagnetic switch 7 is updated is provided, and the duty ratio is set to 100% again and the current value A is raised to 100% only in this period. This RL update period will be described later with reference to FIG. 5.

The duty ratio of 0 to 100% which is illustrated in chronological order from left to right in FIG. 4(*d*) is controlled by the arithmetic processing performed by the PMW control units 21, 22, and 23 formed inside the microcomputer control unit 11 illustrated in FIG. 3. As a result, PWM output signals as High and Low signals that turn on and off at a desired duty ratio and appropriately timing are output from the PMW control units 21 to 23.

FIG. 5 is a flowchart illustrating a processing procedure when the operation coil is controlled in the present device of FIGS. 1 and 3. FIG. 5(*a*) illustrates pull-in processing, FIG. 5(*b*) illustrates voltage and current measurement and duty update processing, and FIG. 5(*c*) illustrates RL acquisition processing.

As illustrated in FIG. 5(*a*), the pull-in processing has processing S1 of setting the PWM output signal to duty 100%, processing S2 of measuring voltage and current, processing S3 of determining whether or not a transient response is completed, coil RL calculation processing S4, and processing S5 of determining whether or not a pull-in time has elapsed.

Immediately after the main switch 7 is turned on, the control unit 11 sets a pull-in period in which the PWM output signal is set to the duty 100% output in order to secure a pull-in current for securely closing the main switch 7 (S1).

Subsequently, while measuring the average current A of the operation coils 16 and 17 (S2) so as not to fall below the closed-circuit holding current W of the main switch 7, it is determined whether or not the transient response is completed (S3). When the determination result in S3 is No, the voltage and current measurement processing S2 is continued as it is. When the determination result in S3 is Yes, the coil RL calculation processing S4 is performed. Subsequently, when the determination result of whether or not the pull-in time has elapsed in S5 is No, the coil RL calculation processing S4 is continued as it is. When the determination result in S5 is Yes, the pull-in processing is ended.

As illustrated in FIG. 5(*b*), the voltage and current measurement and duty update processing has voltage and current measurement processing S6, power supply (terminal) voltage near-future value calculation processing S7, coil current near-future value calculation processing S8, control range determination processing S9, PMW control duty recalculation processing S10, and PMW control output duty change processing S11.

In the voltage and current measurement processing S6, the terminal voltage V and the current value A of the operation coils 16 and 17 are measured. In the power supply voltage near-future value calculation (voltage prediction) processing in S7, the near-future voltage value X is calculated based on a situation in which the terminal voltage V is changed in the latest past.

In the coil current near-future value calculation (current prediction) processing S8, the near-future predicted current value Y flowing through the operation coils 16 and 17 is estimated based on the near-future voltage value X.

In the control range determination processing S9, it is determined whether or not the estimated predicted current value Y is below the threshold value W.

When the predicted current value Y falls below the threshold value W in S9 (Yes in S9), it is determined that the predicted current value is out of the range in which the current of the operation coils 16 and 17 is holdable. That is, it is determined that the predicted current value falls below the coil current value W of the minimum required to stably maintain the attraction state of the contact 13. When the determination result in S9 is No, the processing returns to S6.

When the determination result in S9 is Yes, the processing proceeds to the PMW control duty recalculation processing S10. In S10, an optimum duty ratio is recalculated and obtained based on the predicted current value Y. Subsequently, the processing proceeds to the PMW control duty change processing S11, and the PWM output signal is output at the optimum duty ratio obtained in S10.

Figure 5C:
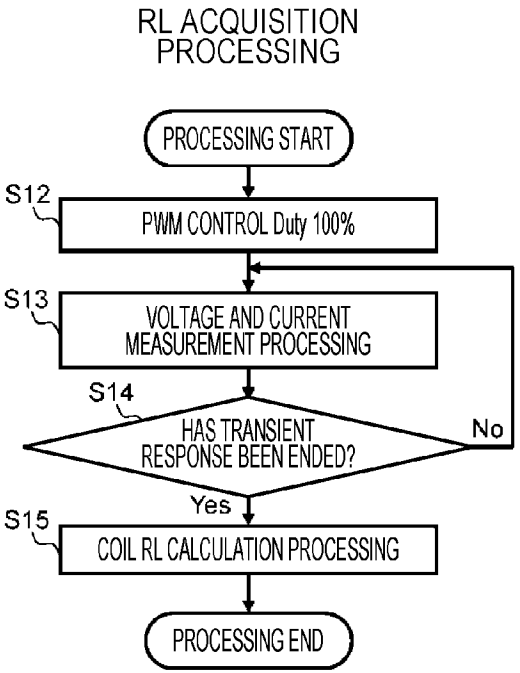

As illustrated in FIG. 5(C), the RL acquisition processing has PWM control duty 100% output processing S12, voltage and current measurement processing S13, determination processing S14 of determining whether or not the transient response is completed, and coil RL calculation processing S15. Since S12 to S15 of FIG. 5(C) are equivalent to S1 to S4 of FIG. 5(A), the description thereof will be omitted.

In FIG. 5(C), a series of processing is ended when the coil RL calculation processing S15 is ended. On the other hand, in FIG. 5(A), the pull-in time for the electromagnetic switch 7 to shift to the closed circuit state has elapsed, and thus, a state changes. That is, the processing is ended after the electromagnetic switch 7 shifts from the open circuit state to the closed circuit state.

When the supply voltage Vcc of the electromagnetic switch 7 fluctuates, a response delay (also referred to as a "primary delay") is unavoidable in general PWM control of the prior art, and there may be a problem that the fluctuation cannot be countered. This primary delay is caused by a transient phenomenon defined by a time constant (hereinafter, a "RC time constant", a "RL time constant", or simply a "time constant") T on which the resistor R, the capacitor C, or a coil L acts with respect to a DC power supply voltage E.

Such a transient phenomenon will not be illustrated, and the theory thereof may be briefly described. In the theoretical description, the power supply voltage E is simplified instead of the DC supply voltage Vcc. The power supply voltage E, the resistor R, the capacitor C, and the coil L, and a current I that gradually changes when the power supply voltage, the resistor, the capacitor, and the coil are energized, each terminal voltage, and the like can be numerically calculated by using well-known differential equations and natural functions. However, the description is simplified here, and it is illustrated that a certain degree of perspective can be obtained even with the simple definition of the time constant T to be described below.

The transient phenomenon defined by the time constant T is a phenomenon that occurs in a procedure of shifting from a certain steady state to the next steady state. More specifically, when the DC power supply E is connected to a series circuit having the capacitor C or the coil L with the resistor R interposed therebetween and the switch is turned on or off, the voltage and current I of each part of the circuit settle down to the next state while being gradually changed.

Here, as an example, a steady-state current value Is=E/R that shifts to the next steady state with respect to a maximum change width E of the voltage accompanying the change of the DC power supply E from off to on. It is assumed that the settled current value Is is defined as a steady-state value Is. A criterion for expressing a rate of change until the current value settles down is the time constant T. As the time constant T becomes smaller, the change becomes more sudden, and as the time constant T becomes larger, the slower the change.

In the present device 3, the impedance Z is a transient variable obtained from the terminal voltage V of the operation coils 16 and 17 and the current value A flowing through the operation coils 16 and 17, but can be regarded as a constant approximated over a predetermined period from a latest past to a present time. That is, after the time constant T is considered, the impedance can be regarded as a constant approximated as an impedance Z≈R=E/I.

This time constant T is defined as a time until the current value becomes about 0.63 times the steady-state value Is in a direction from off to on. On the contrary, the time constant T and the time until the current value becomes about 0.37 times a steady-state value I becomes are defined in a direction from on to off.

The time constant of the RC series circuit T=C·R [seconds], and the time constant of the RL series circuit T=L/R [seconds].

The power supply voltage E, the resistor R, the capacitor C, and the coil L can be numerically measured in real time by combining with a measuring instrument or the microcomputer control unit 11, and may be considered as known constants. However, since these constants have temperature characteristics, for example, when these constants are carried out in the hybrid vehicle, the storage battery vehicle, or the like, these constant are designed in consideration of the temperature characteristics.

In the calculation method of the RL values described above, may calculate the control duty may be calculated with a configuration in which the RL values are recorded as a map (table) inside the microcomputer control unit 11 in advance.

In the above <2>, after the contact 13 of the electromagnetic switch 7 is connected, the duty control is performed such that a certain current value A flows through the operation coils 16 and 17 in order to reduce power consumption. In the above <2>, when there is a sudden fluctuation in the terminal voltage V, since the operation coils 16 and 17 have the time constants T, current waveforms of the coil current A are delayed with respect to a waveform of the terminal voltage V.

When duty adjustment using the PMW control is performed based on the delayed current A in this manner, since it is necessary to anticipate that a delay occurs in the control, the coil current is controlled to a high current level by unnecessarily providing a margin for the threshold value W in the related art. As a result, there is a disadvantage that the power consumption for turning on the electromagnetic switch 7 increases. The present invention is to eliminate this disadvantage.

According to the present device 3 and the present method, the resistance value R and the inductance value L (RL values) of the operation coils 16 and 17 are calculated from a transient response waveform when the contact 13 is switched from off to on. A theory for calculation uses the fact that "the time constant T is defined as the time until the current value becomes about 0.63 times the steady-state value Is in the direction from off to on" and "the time constant of the RL series circuit T=L/R [seconds]".

Based on the theory of the transient phenomenon described above, the resistance value R and the inductance value L (RL values) of the operation coils 16 and 17 can be calculated from the transient response waveform when the contact 13 is switched from off to on. The current fluctuation from the voltage waveform of the terminal voltage V is predicted based on the calculated RL values, and thus, even though there is a sudden fluctuation of the terminal voltage V, it can be fed back to the duty control without delay.

As a result, since the margin for the threshold value W can be set to be smaller than in the related art, the power consumption for turning on the electromagnetic switch 7 can be reduced. Since these RL values change depending on a temperature, for example, when the electromagnetic switch 7 is adopted in the hybrid vehicle or the storage battery vehicle, the RL values are calculated periodically in consideration of the temperature change while the vehicle is running, and thus, more precise control can be performed.

Modification Example

Next, a more realistic modification example will be briefly described. In this modification example, the basic operations to be illustrated below are the same as those of the present device 3 and the present method described above. That is, the terminal voltage V of the operation coils 16 to 18 is measured by the operation coil voltage measurement circuits (ADCs) 24, 25, 27, and 29 of the microcomputer control unit 11 via the voltage measurement filter circuits 31 to 34.

The microcomputer control unit 11 calculates the near-future value X of the terminal voltage V of the operation coils 16 and 17 from the acquired terminal voltage V. The near-future value Y of the current A corresponding to the present duty value is predicted based on the near-future voltage value X and the impedance Z. When the predicted near-future value Y is out of a predetermined control current range, the PWM control units 21 to 23 recalculate the duty, and switches a ratio between the on time and the off time of the switching elements 38 and 39, that is, the duty ratio. Up to this processing, the modification example is the same as that of the present device 3 and the present method described above.

On the other hand, the features of the modification example are as follows. First, when the current value A flowing through the operation coils 16 and 17 drops, processing of determining whether or not the cause is a reflux current path of the operation coils 16 and 17, for example, abnormal disconnection of the freewheeling diodes 41 and 42 and processing of determining whether or not the cause is the decrease in the terminal voltage V are executed.

As a result of the determination processing, when it is determined that the cause of the decrease in the current value A is the abnormal disconnection of the reflux current path or the decrease in the terminal voltage V, processing of increasing the control duty is executed in order to raise the operation coil current A to the holding current or more. As a result of the processing of increasing such a control duty, processing of determining whether or not the current of the operation coils 16 and 17 can be held is performed.

As a result of the processing, when it is predicted that the current of the operation coils 16 and 17 cannot be held, the microcomputer control unit 11 switches the duty value to 100% in order to cope with the significant decrease in the supply voltage Vcc of the electromagnetic switch 7. When it is determined that the closed-circuit holding current lower limit W of the electromagnetic switch 7 cannot be maintained even with the duty 100%, the output of the signal that turns on to both the electromagnetic switches 17 and 18 is stopped. That is, when the current value falls below or is expected to fall below the threshold value W, in order to prevent a serious failure in which the contact 13 of the electromagnetic switch 7 is welded due to a decrease in a contact force in advance, a supply voltage decrease abnormality is diagnosed and the output of the on signal is stopped.

At this time, the microcomputer control unit 11 immediately stops the PMW control, and performs control such that the electromagnetic switches 7 and 8 are switched from on to off. When this modification example is adopted in the hybrid vehicle or the storage battery vehicle, the electromagnetic switches 7 and 8 can be prevented from being damaged by stopping a power running or regeneration operation in the vehicle. The electromagnetic switch 8 may be excluded from the protection target.

At this time, a true cause such as over-discharging of the battery that supplies the main power supply Vcc for driving needs to be investigated. When the cause is the over-discharge of the battery in the storage battery vehicle, the failure does not occur, and a fuel shortage in a gasoline vehicle or the like merely occurs. In that case, control is realized in which priority is given to preventing a serious failure in which the electromagnetic switch 7 is welded due to a decrease in contact force. From such an effect, the present invention is suitable for an application for the purpose of monitoring the charging and discharging state of the battery in the power supply system using the assembled battery as the power supply.

Next, the main points of the present invention will be described along with the scope of claims.

[1]

The electromagnetic switch control device (present device) 3 is a control device that energizes the current value A having the PWM-controlled duty ratio to the operation coils 16 and 17, and opens and closes the electrical contact 13 of the electromagnetic switch 7 by the electromagnetic force corresponding to the current value A. The present device 3 includes the current value prediction unit 19, the control range determination unit 20, and the PWM control units 21 to 23.

The current value prediction unit 19 estimates the near-future predicted current value Y by using the terminal voltage V of the operation coils 16 and 17. The control range determination unit 20 determines whether or not the estimated predicted current value Y is out of the range in which the current of the operation coils 16 and 17 is holdable, that is, the electromagnetic force to maintain the contacts 13 in the attraction state is exhibitable and maintainable.

When the determination result based on the predicted current value Y of the control range determination unit 20 is out of the range in which the electromagnetic force is maintainable, the PWM control unit 21 performs control such that the duty ratio is changed based on the predicted current value Y. Since the present device 3 is configured in this manner, the PWM control unit 21 can stabilize the contact pressure of the contacts 13 by predicting the near-future value Y of the operation coil current A and performing control such that the near-future value does not fall below the holding current threshold value W.

[2]

In the present device 3, it is preferable that the predicted current value Y is estimated by using the impedance Z of the operation coils 16 and 17. That is, the microcomputer control unit 11 calculates the near-future value X of the terminal voltage V of the operation coils 16 and 17 from the acquired terminal voltage V. The near-future value Y of the current A corresponding to the present duty value is predicted based on the near-future voltage value X and the impedance Z.

[3]

In the present device 3, the impedance Z is the transient variable obtained from the terminal voltage V of the operation coils 16 and 17 and the current value A flowing through the operation coils 16 and 17, but can be regarded as the constant approximated over a predetermined period from the latest past to the present time. More specifically, after the time constant T is considered, the impedance can be regarded as the constant approximated as the impedance $Z \approx R = E/I$.

This time constant T is defined as the time until the current value becomes about 0.63 times the steady-state value Is in the direction from off to on. On the contrary, the time constant T and the time until the current value becomes about 0.37 times a steady-state value I becomes are defined in a direction from on to off. Even the impedance Z calculated as the transient variable based on the theory of such a transient phenomenon can be approximated to the constant when the impedance is divided into a predetermined period from the latest past to the present time.

Accordingly, the predicted current value Y can be estimated by using the impedance Z of the operation coils 16 and 17.

[4]

It is preferable that the constant that approximates the impedance Z is updated for each predetermined period in order to estimate the near-future predicted current value Y from the present time. The coil L, the resistor R, or the capacitor C forming the impedance Z can be numerically measured in real time by combining with the measuring instrument or the microcomputer control unit 11, and may be considered as a known constant. However, since these constants have temperature characteristics, for example, when these constants are carried out in the hybrid vehicle, the storage battery vehicle, or the like, these constant are designed in consideration of the temperature characteristics. That is, it is preferable that the constant approximated from the non-constant impedance Z is updated for each predetermined period.

[5]

It is preferable that the present device 3 forms a control function for appropriately turning on and off the electric circuit in the combination in which the battery-type power supply system formed by the assembled battery 6 constituted by the plurality of secondary batteries 4 connected in series or in parallel, the loads that receive the supply of the power from the system, and the electromagnetic switches 16 to 18 inserted into current paths thereof. The assembled battery 6 is further connected to voltage measurement functions similar to the ADCs 24, 25, and 27 and the voltage measurement filter circuits 31, 32, and 33.

The ADCs 24, 25, and 27 measure the terminal voltage V of the operation coils 16 and 17. The voltage measurement filter circuits 31, 32, and 33 are provided between the operation coil 16 and 17 and the operation coil voltage measurement circuits (ADCs) 24, 25, and 27. It is preferable that the predicted current value Y is calculated by using the terminal voltage V of the operation coils 16 and 17, the impedance Z of the operation coils 16 and 17, and the time constant T1 of the voltage measurement filter circuits 31, 32, and 33.

[6]

It is preferable that the assembled battery 6 is further connected to the operation coil current measurement circuits (ADCs) 26 and 28 and the current measurement filter circuits 35 and 36. The operation coil current measurement circuits 26 and 28 measure the current energized to the operation coils 16 and 17. The current measurement filter circuits 35 and 36 are provided between the operation coils 16 and 17 and the operation coil current measurement circuits 26 and 28.

It is preferable that the impedance Z is calculated by using the terminal voltage V, the time constant T1 of the voltage measurement filter circuits 31, 32, and 33, the current value A, and the time constant T2 of the current measurement filter circuits 21 to 23.

[7]

It is preferable that the impedance Z is calculated from the current value A and the terminal voltage V of the operation coils 16 and 17 in the on period in which the duty ratio in the PWM control is 100% in order to set the electrical contact 13 to be in the closed circuit state. Regarding this, in the RL update period mode of the above <3>, the mode in which the duty ratio of the PWM control is 100% in the RL update period for correcting the amount of drift of the impedance Z of the operation coils 16 and 17 in the electromagnetic switch 7 as in the pull-in period (see FIG. 5(*c*)) is as described.

[8]

The electromagnetic switch control method (present method) is a control method for performing PWM control of the current value A flowing through the operation coils 16 and 17 of the electromagnetic switch 7 by the PWM control units 21 to 23 and opening and closing the electrical contacts 13 by the electromagnetic force corresponding to the energization of the PWM-controlled duty ratio. This method includes the voltage and current measurement processing S6, the current prediction processing S8, and the PWM control processing S9 to S11. In the voltage and current measurement processing S6, the terminal voltage V and the current value A of the operation coils 16 and 17 are measured.

In the current prediction processing S8, the near-future predicted current value Y flowing through the operation coils 16 and 17 is estimated. In the PWM control processing S9 to S11, when it is determined that the estimated predicted current value Y is out of the range in which the current of the operation coils 16 and 17 is holdable, the control is performed such that the duty ratio is changed based on the predicted current value Y.

In the present method, since the current value A flowing through the operation coils 16 and 17 of the electromagnetic switch 7 is controlled by such a procedure, the PWM control unit 21 predicts the near-future value Y of the operation coil current A by the current prediction processing S8, and performs control such that the estimated predicted current value Y does not fall below the holding current threshold value W by the PWM control processing S9 to S11. Thus, the contact pressure of the contact can be stabilized. The operation coil current A can be reduced to the minimum necessary, and the control cycle can be reduced by the amount of precision control.

The present invention is not limited to the application of battery monitoring in the power supply system using the assembled battery as the power supply. In addition, the present invention is applicable to any application for controlling the opening and closing of the connection between the power supply and the load.

REFERENCE SIGNS LIST

1 motor
2 inverter
3 electromagnetic switch control device (present device)
4 battery cell
5 battery module
6 assembled battery
7 main contactor (main switch, electromagnetic switch)
8 precharge relay (sub switch)
9 precharge resistor
10 electromagnetic switch power supply (contactor power supply)
11 microcomputer control unit
12 voltage measuring line
13 contact
14 switching element
15 coil current contactor (coil switch, electromagnetic switch)
16,17,18 operation coil
19 current value prediction unit
20 control range determination unit
21 PMW control
24,25,27,29 operation coil voltage measurement circuit (ADC)
26,28,30 operation coil current measurement circuit
31,32,33,34 voltage measurement filter circuit (ADC)
35,36,37 current measurement filter circuit
41,42 freewheeling diode
A terminal voltage value
T1 time constant (of voltage measurement filter circuit 31, 32, 33)
T2 time constant (of current measurement filter circuit 35, 36)
W holding current (lower limit) threshold value
X near-future predicted voltage value
Y near-future predicted current value
Z impedance

The invention claimed is:

1. An electromagnetic switch control device that energizes a current value having a PWM-controlled duty ratio to an operation coil, and opens and closes an electrical contact by an electromagnetic force corresponding to the current value, the electromagnetic switch control device comprising:

a current value prediction unit that estimates a near-future predicted current value by using a terminal voltage value of the operation coil;

a control range determination unit that determines whether or not the estimated predicted current value is out of a range in which a current of the operation coil is holdable; and a PWM control unit that performs control such that the duty ratio is changed based on the predicted current value when a determination result of the control range determination unit is out of the range.

2. The electromagnetic switch control device according to claim 1, wherein the predicted current value is estimated by using an impedance of the operation coil.

3. The electromagnetic switch control device according to claim 2, wherein the impedance is a transient variable obtained by a terminal voltage value of the operation coil and a current value flowing through the operation coil and is a constant approximated over a predetermined period from a latest past to a present time.

4. The electromagnetic switch control device according to claim 3, wherein the constant that approximates the impedance is updated for each predetermined period in order to estimate a near-future predicted current value from a present time.

5. The electromagnetic switch control device according to claim 2, wherein the electromagnetic switch control device is used in connection with an assembled battery including a plurality of secondary batteries connected in series or in parallel, and further connects an operation coil voltage measurement circuit that measures a terminal voltage value of the operation coil and a voltage measurement filter circuit provided between the operation coil and the operation coil voltage measurement circuit to the assembled battery, and the predicted current value is calculated by using the terminal voltage value of the operation coil, the impedance of the operation coil, and a time constant of the voltage measurement filter circuit.

6. The electromagnetic switch control device according to claim 5, wherein the assembled battery is further connected to an operation coil current measurement circuit that measures the current of the operation coil and a current measurement filter circuit provided between the operation coil and the operation coil current measurement circuit, and the impedance is calculated by using the terminal voltage value, a time constant of the voltage measurement filter circuit, the current value, and a time constant of the current measurement filter circuit.

7. The electromagnetic switch control device according to claim 6, wherein the impedance is calculated from the current value and the terminal voltage value of the operation coil in an on period in which a duty ratio in the PWM control is 100% in order to set the electrical contact to be in a closed circuit state.

8. An electromagnetic switch control method for PWM-controlling a current value flowing through an operation coil of an electromagnetic switch by a PWM control unit and opening and closing an electrical contact by an electromagnetic force corresponding to energization of the PWM-controlled duty ratio, the electromagnetic switch control method comprising:

voltage and current measurement processing of measuring a terminal voltage value and a current value of the operation coil;

current prediction processing of estimating a near-future predicted current value flowing through the operation coil; and PWM control processing of performing control such that the duty ratio is changed based on the predicted current value when it is determined that the estimated predicted current value is out of a range in which a current of the operation coil is holdable.

* * * * *